US005638850A

United States Patent [19]

Hazinski et al.

[11] Patent Number: 5,638,850

[45] Date of Patent: Jun. 17, 1997

[54] TENT RAIN FLY AND METHOD

[76] Inventors: Daniel P. Hazinski, 4481 SW. 34th Ter., Ft. Lauderdale, Fla. 33312; Sidney Samole, 6755 SW. 152nd St., Miami, Fla. 33157

[21] Appl. No.: 191,366

[22] Filed: Feb. 3, 1994

[51] Int. Cl.[6] ..... E04H 15/58; E04H 15/32

[52] U.S. Cl. ..... 135/120.1; 135/97; 135/115; 135/117; 135/87

[58] Field of Search ..... 135/120.1 OR, 135/120.2, 120.3, 115, 87, 97, 117, 120.4

[56] References Cited

U.S. PATENT DOCUMENTS

| | | | |
|---|---|---|---|
| 3,598,133 | 8/1971 | Abert | 135/115 X |
| 3,621,857 | 11/1971 | May et al. | 135/102 X |
| 3,670,747 | 6/1972 | Pohl et al. | 135/105 X |
| 3,943,952 | 3/1976 | Marquart et al. | 135/97 X |
| 4,078,572 | 3/1978 | Moss | 135/97 |
| 4,102,352 | 7/1978 | Kirkham | 135/97 |
| 4,165,757 | 8/1979 | Marks | 135/104 X |
| 4,285,355 | 8/1981 | Lundblade | 135/109 X |
| 4,491,141 | 1/1985 | Eppenbach | 135/87 X |
| 4,709,718 | 12/1987 | Nichols | 135/97 X |

FOREIGN PATENT DOCUMENTS

| | | | |
|---|---|---|---|
| 1049923 | 1/1954 | France | 135/97 |
| 0219823 | 6/1942 | Switzerland | 135/97 |

*Primary Examiner*—Wynn E. Wood
*Attorney, Agent, or Firm*—Richard M. Saccocio

[57] ABSTRACT

A rain fly for use primarily on self-erecting enclosures which enclosures have sleeves for accommodating a wire or monofilament is disclosed. More specifically, this fly is characterized by a pair of monofilaments on the two sides of the fly which go from the front to the rear of the enclosure. The wires are secured interiorly of elongate sleeves at the lateral edges of the rain flap. The wires are proportioned to have their ends inserted into four sleeves flanking the internal wire of the tent. Means are provided for four stabilizers which extend front and rear and side to side. The function of the stabilizer is to assist in holding the fabric in spaced relationship from the enclosure to thereby permit ventilation. Optionally, a zipper-like opening is provided for a door cover, and a Velcro flap for securing one portion of the flap door cover for easy entrance. A crescent-shaped hood depends from each of the wire members at the sides which drops down over the windows of the enclosure thereby permitting the fully assembled fly to ride in spaced relationship away from the underlying enclosure, and yet to be folded into a compact circle when the underlying enclosure itself is folded.

8 Claims, 2 Drawing Sheets

TENT RAIN FLY AND METHOD

FIELD OF THE INVENTION

The present invention relates to a rain fly for use on a tent. More particularly it relates to a rain fly which can be accommodated to coact with a self-erecting enclosure type tent.

BACKGROUND OF THE INVENTION

The present invention is directed to the self-erecting type enclosures such as exemplified in two Norman U.S. Pat. Nos. 3,960,161 and 3,990,463 and also as exemplified in McLeese U.S. Pat. No. 4,858,634 and Ivanovich, et al U.S. Pat. No. 5,163,461. More specifically, however, those patents do not show a separate rain fly which is spaced away from the top portion of the enclosure when erected. In addition, there is no rain fly which accommodates opening the door, or opening the windows.

When a rain fly is employed by certain persons in the field with a tent such as exemplified in McLeese U.S. Pat. No. 4,858,634, the present ones used are not spaced away from the tent and merely supported at four corners and the flap material will sag attributable to its own weight. Upon sagging it contacts the non-water proof fabric below and invites leakage as well as blocks any ventilation that might otherwise occur if the rain fly was constantly spaced from the enclosure. Therefore a desirable result is to provide a rain fly which is spaced from the enclosure and which additionally, and desirably, has a provision for accommodating door entrance and exit as well as window opening enclosure.

SUMMARY OF THE INVENTION

The present invention is directed to a rain fly for use primarily on self-erecting enclosures which enclosures have sleeves for accommodating a wire or monofilament. More specifically, this fly is characterized by a pair of monofilaments on the two sides of the fly which go from the front to the rear of the enclosure. The wires are secured interiorly of elongate sleeves at the lateral edges of the rain flap. The wires are proportioned to have their ends inserted into four sleeves flanking the internal wire of the tent. Means are provided for four stabilizers which extend front and rear and side to side. The function of the stabilizer is to assist in holding the fabric in spaced relationship from the enclosure to thereby permit ventilation. Optionally, a zipper-like opening is provided for a door cover, and a Velcro flap for securing one portion of the flap door cover for easy entrance. A crescent-shaped hood depends from each of the wire members at the sides which drops down over the windows of the enclosure thereby permitting the fully assembled fly to ride in spaced relationship away from the underlying enclosure, and yet to be folded into a compact circle when the underlying enclosure itself is folded.

In view of the foregoing, it is a principal object of the present invention to provide a rain fly which will erect in a spaced relationship from the underlying self-erecting enclosure. An important related object of the invention is to provide means for door access as well as means for window coverage with the rain flap.

An additional advantage of the present invention is that a rain flap can be constructed to accommodate a wide variety of self-erecting enclosures such as exemplified in the above-identified patents, and not dedicated to any particular self-erecting enclosure.

BRIEF DESCRIPTION OF THE DRAWINGS

Further objects and advantages of the present invention will become apparent as the following description proceeds, taken in conjunction with the accompanying illustrative drawings, in which.

DESCRIPTION OF THE PREFERRED EMBODIMENT

Figure 1:
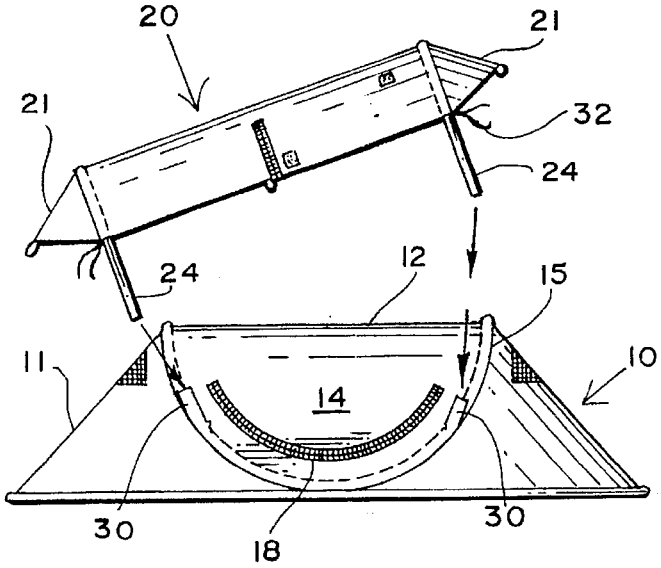
FIG. 1 is a front elevation of an erected enclosure illustrating diagrammatically the spaced relationship of the rain fly.
Figure 2:
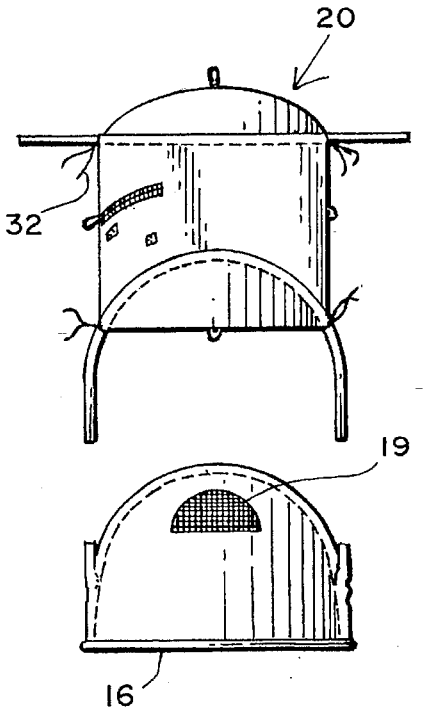
FIG. 2 is a side elevation taken in the same scale as FIG. 1 showing the spaced relationship from the ends.

The subject matter of the present invention is disclosed in exploded form in FIG. 1 where the tent 10 includes ends 11, and a cover 12. Provision is made for a door 14 which is secured in place by the door closer 18 and above the bottom or the floor 16. At least one window 19 is provided in one end of the tent 10 as shown in FIG. 2.

Figure 3:
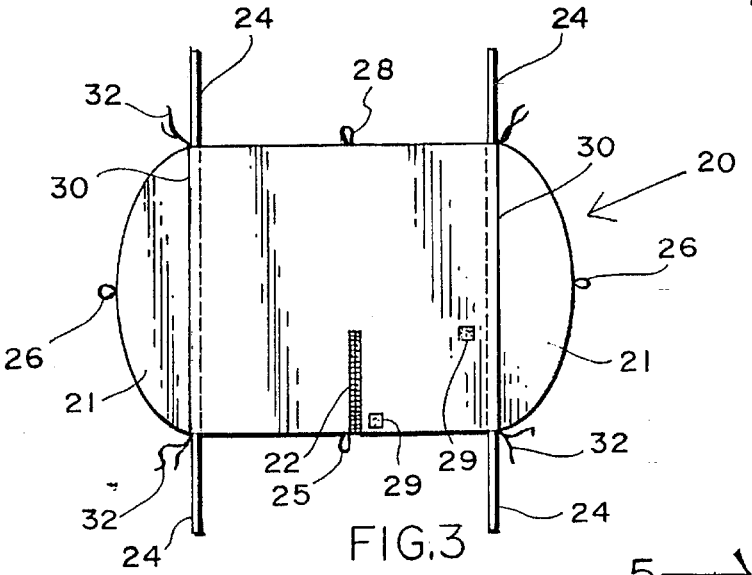
FIG. 3 is a plan view of the rain fly.
Figure 4:
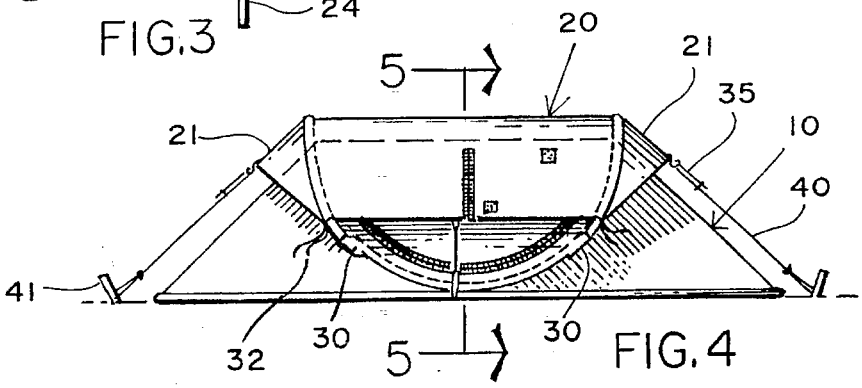
FIG. 4 is a front elevation of the tent with the rain fly in place.
Figure 5:
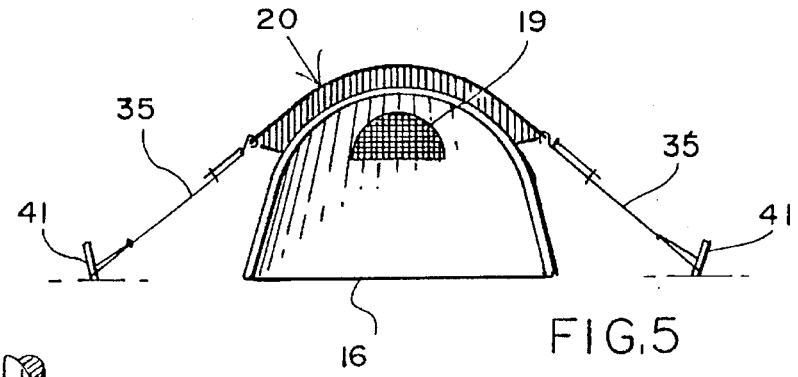
FIG. 5 is a transverse sectional view taken through section line 5—5 of FIG. 4 and in essentially the same scale as FIG. 4.
Figure 8:
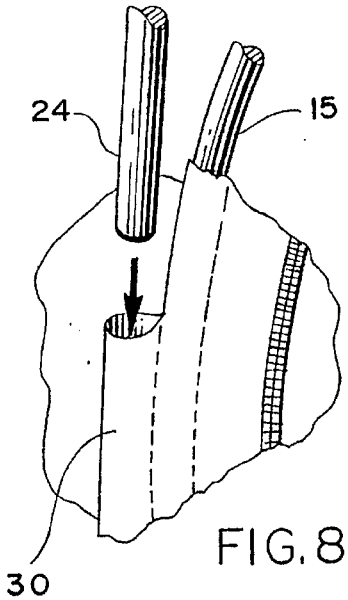
FIG. 8 is an enlarged broken view showing the insertion of the fly wire into a wire sleeve on the tent and enlarged from that portion of FIG. 7 identified with the dotted circle and the number 8.
Figure 6:
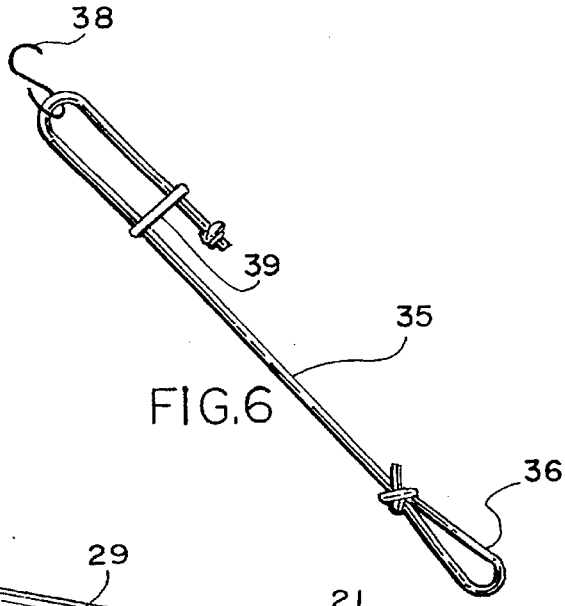
FIG. 6 is an assembly view of the loop hook assembly.

Continuing with FIG. 1 it will be seen that the rain fly 20 has lateral window shields 21 which are crescent shape as shown in FIG. 3. The rain fly has its own rain fly wires 24 which are inserted into pre-existing sleeves 30 in the tent 10 (shown in greater detail in FIGS. 7 and 8). A door opener 22 is provided in the rain fly 20 and may be removably secured in a partially open view by the door flap stops 29 which are releasably securable patches such as Velcro secured to the rain fly 20 itself. Provision is made for a door anchor loop 25 and side anchor loops 26 along with a rear anchor loop 28. These are secured to complete the assembly as will be described hereinafter. Two ties 32 are secured to each of the four corners of the fly 20. These are tied to the exposed tent wire 15 as shown in FIG. 8 to prevent the fly wires 24 from coming out of the wire sleeves 30 in the tent when closed or erected.

Figure 7:
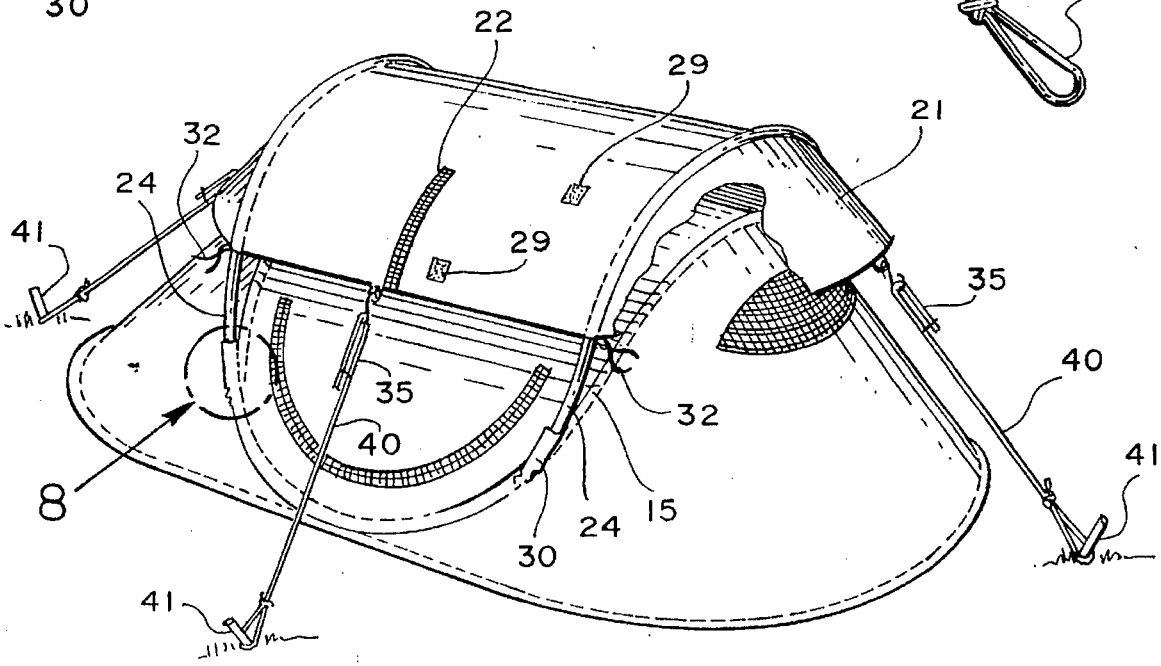
FIG. 7 is a perspective view of the tent and associated assembled rain fly.

In assembling the rain fly 20 to the tent 10, the ends of the rain fly wire 24 are inserted into a sleeve 30 which is on the tent 10 adjacent to the tent wire 15. This is best shown in FIGS. 7 and 8. Once the four ends of the fly wire 24 are inserted in the sleeves 30, the loop hook assembly 35 with its line tie 36 and hook 38 are assembled to anchor line 40 and then to the stakes 41.

The method of the present invention comprises the assembly steps of securing the ends of the fly wire 24 in the pre-existing sleeves 30 of the tent 10. After all of them are in place, the lines 40 are secured at one end to a stake 41, and the other end 35 is the loop hook assembly which secures into the four loops on the rain fly. Once assembled, the tendency of the fly wire 24 to want to turn out and go straight holds the entire rain fly 20 above and in spaced relationship to the tent below. In addition, the side lines 40 which are secured to the window shields 21 hold them out in spaced and covered relationship to any windows 19 such as are on the tent 10. When access to the door is required, a zipper-like structure which is the door opener 22 is open, and the lower corner flap is folded back so that the door flap stops 29 engage each other, the one being at the lower corner of the opening, and the other being on a diagonally opposed portion of the rain fly 20 itself. Tightening of the lines 40 is materially assisted by manipulating the ends of the loop hook assembly 35.

Although particular embodiments of the invention have been shown and described in full here, there is no intention to thereby limit the invention to the details of such embodiments. On the contrary, the intention is to cover all modifications, alternatives, embodiments, usages and equivalents as fall within the spirit and scope of the present invention, specification and appended claims.

What is claimed is:

1. A tent and a rain fly comprising:

a tent comprising a frame and a covering attached to said frame, a plurality of sleeved openings in said covering, a rain fly comprising a flexible material, a plurality of sleeved openings in said rain fly material, a flexible rod positioned within each of said sleeved openings in said rain fly material, said flexible rod extending out of said rain fly sleeved opening and received within a respective sleeved opening in said tent covering and anchor means on the rain fly securing a line leading to a tent stake.

2. In the tent and rain fly of claim 1, said tent covering including one or more windows, and said rain fly material including one or more window coverings.

3. In the tent and rain fly of claim 1, said anchor means comprising one or more openings in said rain fly material.

4. In the tent and rain fly of claim 1, said anchor means comprising one or more hook members attached to said rain fly material.

5. The tent and rain fly of claim 1 including a recloseable linear opening in said rain fly material.

6. The tent and rain fly of claim 2 wherein said one or more window coverings are respectively spaced a distance away from said one or more tent windows.

7. A method for attaching a rain fly to a tent comprising the steps of a) providing one or more sleeved openings in said tent;

b) attaching one or more flexible rods to said rain fly such that an end of said one or more flexible rods extends away from said tent fly;

c) positioning an extending end of said one or more flexible rods within said one or more sleeved openings in said tent.

8. The method of claim 7 including the step of anchoring said rain fly to one or more tent pegs.

* * * * *